US009214323B1

(12) United States Patent
Vestal et al.

(10) Patent No.: US 9,214,323 B1
(45) Date of Patent: Dec. 15, 2015

(54) METHOD AND APPARATUS FOR TRANSPORTING SAMPLE PLATES BETWEEN CHAMBERS OF A MASS SPECTROMETER

(71) Applicant: Virgin Instruments Corporation, Sudbury, MA (US)

(72) Inventors: Marvin L. Vestal, Framingham, MA (US); Kevin Hayden, Newton, MA (US)

(73) Assignee: Virgin Instruments Corporation, Sudbury, MA (US)

( * ) Notice: Subject to any disclaimer, the term of this patent is extended or adjusted under 35 U.S.C. 154(b) by 0 days.

(21) Appl. No.: 14/475,528

(22) Filed: Sep. 2, 2014

(51) Int. Cl.

| | |
|---|---|
| ***H01J 49/04*** | (2006.01) |
| ***H01J 49/24*** | (2006.01) |
| ***H01J 49/26*** | (2006.01) |
| ***H01J 49/00*** | (2006.01) |
| ***H01J 49/40*** | (2006.01) |

(52) U.S. Cl.
CPC ..... *H01J 49/0409* (2013.01); *H01J 49/0027* (2013.01); *H01J 49/40* (2013.01)

(58) Field of Classification Search
USPC ..... 250/281, 282, 287, 288, 304, 440.11, 250/441.11, 442.11, 491.1, 492.1, 526
See application file for complete search history.

(56) References Cited

U.S. PATENT DOCUMENTS 5,841,136 A * 11/1998 Holle ..... H01J 49/0495 250/288
RE39,353 E * 10/2006 Vestal ..... H01J 49/164 250/281
7,282,707 B1 * 10/2007 Zanon ..... H01J 49/0409 250/281
2008/0272287 A1 * 11/2008 Vestal ..... H01J 49/40 250/282
2008/0272290 A1 * 11/2008 Vestal ..... H01J 49/164 250/287
2009/0179146 A1 * 7/2009 Lomas ..... B01J 20/286 250/282

* cited by examiner

*Primary Examiner* — Bernard E Souw
(74) *Attorney, Agent, or Firm* — Kurt Rauschenbach; Rauschenbach Patent Law Group, LLC

(57) ABSTRACT

A sample plate handling system for a time-of-flight mass spectrometer includes a sample plate for supporting samples for analysis. A first sample plate receiver is positioned in a first chamber. First and second sample plate receivers are positioned in a second chamber. A first gate valve isolates the first and second chambers when closed and allows transfer of sample plates between the first sample plate receiver in the first chamber and one of the first and second sample plate receivers in the second chamber when the first gate valve is open. A first linear extender pushes a sample plate from the first sample plate receiver in the first chamber to the first sample plate receiver positioned in the second chamber, and then retracts a second sample plate from the second sample plate receiver positioned in the second chamber and transports the second sample plate to the first sample plate receiver in the first chamber. A first sample plate receiver is positioned in a third chamber. A second gate valve isolates the third chamber from the second chamber when closed and allows transfer of sample plates between the first sample plate receiver in the third chamber and one of the first and second sample plate receivers in the second chamber when the second gate valve is open. A second linear extender pushes a sample plate from the first sample plate receiver in the third chamber to the first sample plate receiver positioned in the second chamber, and then retracts the second sample plate from the second plate receiver positioned in the second chamber and transports it into the third chamber.

22 Claims, 7 Drawing Sheets

Microtiter Compatible Plate Holder comprising 4 sample plate receivers

METHOD AND APPARATUS FOR TRANSPORTING SAMPLE PLATES BETWEEN CHAMBERS OF A MASS SPECTROMETER

The section headings used herein are for organizational purposes only and should not to be construed as limiting the subject matter described in the present application in any way.

INTRODUCTION

Many modern mass spectrometers that analyze samples deposited on a solid surface require that the pressure inside the ion source be sufficiently low to ensure that ions produced by the ionization process only rarely collide with present neutral molecules. Such mass spectrometers require a pressure inside the ion source to be less than $10^{-6}$ atmospheres (one atmosphere equals 760 Torr), and often even require a pressure inside the ion source to be $10^{-5}$ Torr or below. Vacuum pumps used for achieving very low pressure are well known in the art. The time required for achieving a given vacuum level is limited by the various system and vacuum pump parameters, such as the vacuum pumping speed, the volume of the vacuum chamber being evacuated, and contributions from contaminants present on inner walls of the vacuum chamber that may vaporize at rates that are comparable to the speed of the vacuum pump. These parameters limit the ultimate pressure that can be achieved in the ion source and vacuum chamber.

In one prior art mass spectrometer, the ion source chamber is separated from the mass analyzer chamber with a gate valve connecting them. When the gate valve is open, ions and neutral molecules may move freely between the two chambers. When the gate valve is closed, the vacuum levels and pumping speeds of the two chambers are independent, but the system is inoperative because ions are not transmitted. When a mass spectrometry analysis is completed, the gate valve is typically closed and the ion source chamber is typically vented to atmospheric pressure. The plate is ejected and a new plate is then loaded for additional analysis. The ion source chamber is then evacuated to the required vacuum pressure, at which point the gate valve is opened and analysis of the samples on the new plate may begin. During the time required for this vent/evacuate cycle, the mass spectrometer is not operating, and in some cases, the time required for the vent/evacuate cycle may be as long as, or longer than, the time required to analyze the samples, which leads to poor utilization of the instrument.

BRIEF DESCRIPTION OF THE DRAWINGS

The present teaching, in accordance with preferred and exemplary embodiments, together with further advantages thereof, is more particularly described in the following detailed description, taken in conjunction with the accompanying drawings. The skilled person in the art will understand that the drawings, described below, are for illustration purposes only. The drawings are not necessarily to scale, emphasis instead generally being placed upon illustrating principles of the teaching. The drawings are not intended to limit the scope of the Applicant's teaching in any way.

DESCRIPTION OF THE VARIOUS EMBODIMENTS

Figure 1:
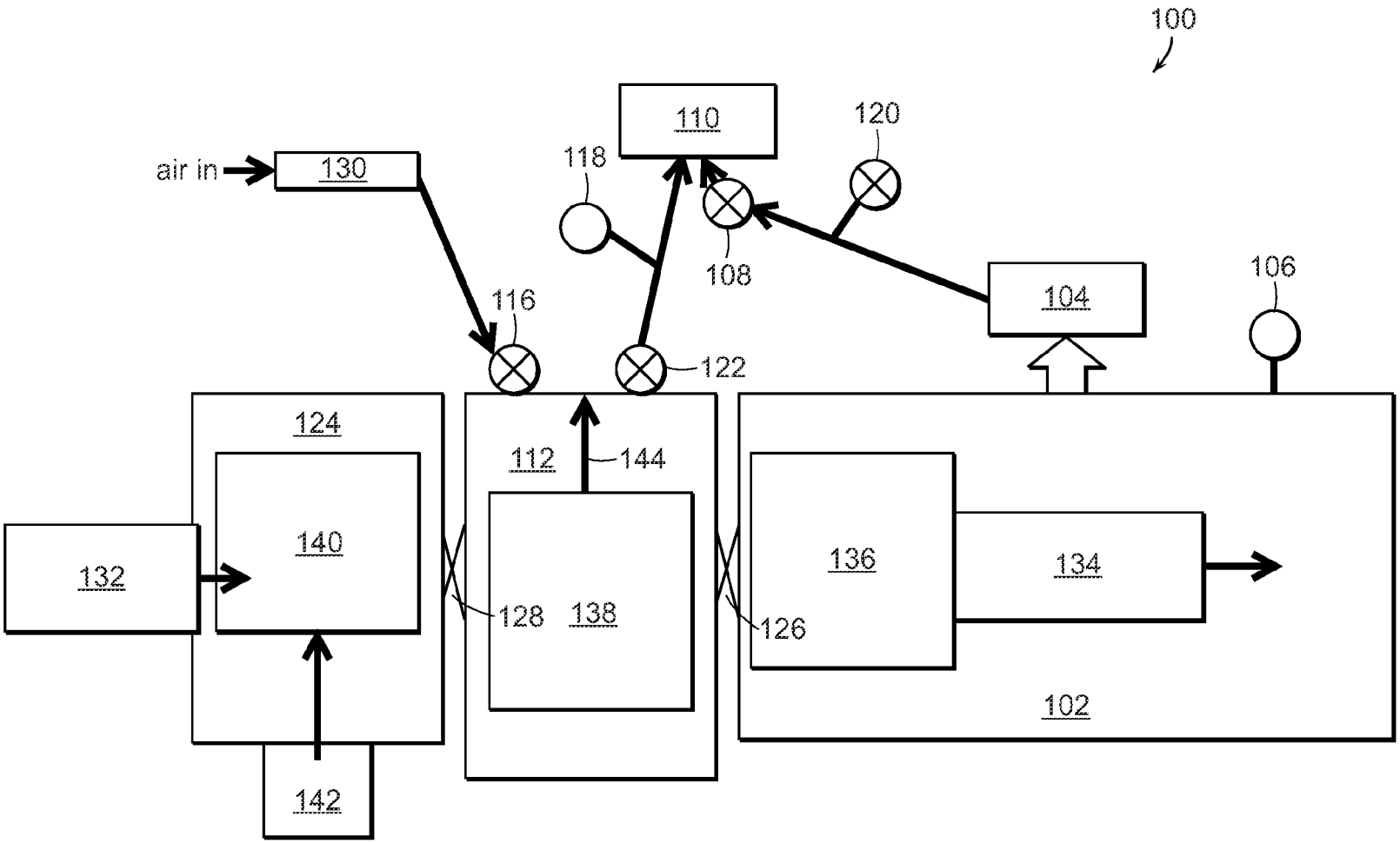
FIG. 1 illustrates a schematic diagram of a sample plate handling system for a mass spectrometer, according to one embodiment of the present teaching.

Reference in the specification to "one embodiment" or "an embodiment" means that a particular feature, structure, or characteristic described in connection with the embodiment is included in at least one embodiment of the teaching. The appearances of the phrase "in one embodiment" in various places in the specification are not necessarily all referring to the same embodiment.

It should be understood that the individual steps of the methods of the present teachings may be performed in any order and/or simultaneously as long as the teaching remains operable. Furthermore, it should be understood that the apparatus and methods of the present teachings can include any number or all of the described embodiments as long as the teaching remains operable.

The present teaching will now be described in more detail with reference to exemplary embodiments thereof as shown in the accompanying drawings. While the present teachings are described in conjunction with various embodiments and examples, it is not intended that the present teachings be limited to such embodiments. On the contrary, the present teachings encompass various alternatives, modifications and equivalents, as will be appreciated by those of skill in the art. Those of ordinary skill in the art having access to the teaching herein will recognize additional implementations, modifications, and embodiments, as well as other fields of use, which are within the scope of the present disclosure as described herein.

There is currently a need for methods and apparatus for transferring sample plates between chambers of a mass spectrometer that are faster, simpler, less expensive, and more reliable than the prior art methods and apparatus in order to improve utilization of mass spectrometer instruments. Many analytical applications, such as tissue imaging and biomarker discovery, require measurements on intact proteins over a very broad mass range. For these applications, speed of analysis can be a more important metric than the instrument's resolving power.

The present teaching relates to methods and apparatus for transferring sample plates between chambers of a mass spectrometer. For example, in one specific embodiment of the present teaching, a sample plate handling system according to the present teaching includes a sample plate with samples of interest on one surface of the sample plate. A first sample plate receiver is positioned in a first chamber. A first and second sample plate receiver is positioned in a second chamber. A first gate valve is positioned between the first chamber and the second chamber so that it isolates the first and second chambers when closed and allows transfer of sample plates between the first sample plate receiver in the first chamber and one of the first and second sample plate receivers in the second chamber when the first gate valve is open. A first linear extender pushes a sample plate from the first sample plate receiver in the first chamber to the first sample plate receiver positioned in the second chamber, and then retracts a second sample plate from the second sample plate receiver positioned in the second chamber and transports the second sample plate to the first sample plate receiver in the first chamber. A first sample plate receiver is positioned in a third chamber. A second gate valve is positioned between the third chamber and the second chamber so that it isolates the third chamber from the second chamber when closed and allows transfer of sample plates between the first sample plate receiver in the third chamber and one of the first and second sample plate receivers in the second chamber when the second gate valve is open. A second linear extender pushes a sample plate from the first sample plate receiver in the third chamber to the first sample plate receiver positioned in the second chamber, and then retracts the second sample plate from the second plate receiver positioned in the second chamber and transports it into the third chamber.

FIG. 1 illustrates a schematic diagram of a sample plate handling system 100 for a mass spectrometer, according to one embodiment of the present teaching. In one embodiment, the first chamber 102 is evacuated by a turbomolecular vacuum pump 104 capable of producing and maintaining a vacuum in the chamber of less than $10^{-6}$ Torr, and the vacuum is monitored by a gauge 106, such as a Bayard-Alpert or BA gauge, suitable from measuring pressures in the range between $10^{-3}$ and $10^{-8}$ Torr. Alternatively, in some embodiments, a cold cathode gauge may be used. The output of the turbomolecular pump 104 is coupled with a solenoid operated valve 108 to a mechanical vacuum pump 110, which maintains the vacuum at the outlet of the turbomolecular pump 104 to a value typically less than 0.01 Torr.

Valve 108 is mounted close to the inlet of the mechanical pump 110 so that the major portion of the volume of the pumping line between turbomolecular pump 104 and mechanical vacuum pump 110 is between the valve 108 and the outlet of the turbomolecular pump 104. A first vent valve 120 is attached to the vacuum line connecting foreline valve 108 to turbomolecular pump 104 and can be opened to vent first chamber 102 to atmospheric pressure for cleaning or otherwise servicing components of the system located therein. The mechanical vacuum pump 110 is also coupled to the second chamber 112 through a second solenoid operated valve 122. The second chamber 112 is coupled to a source of clean dry air by a third solenoid vent valve 116. Both solenoid valves 116, 122 can be mounted directly onto the second chamber 112 to minimize the total effective volume of the second chamber 112. A thermocouple (TC) or other gauge 118 that is suitable for measuring pressure from atmosphere down to 0.01 Torr, monitors the vacuum level at the inlet to the mechanical vacuum pump 110.

The third chamber 124 of the embodiment of the sample plate handling system 100 illustrated in FIG. 1 is at atmospheric pressure. A first gate valve 126 is located between first chamber 102 and second chamber 112 and can be opened to allow sample plates to be transferred between the two chambers 102, 112. Gate valve 126 can be closed to isolate the pressure in first chamber 102 from the pressure in second chamber 112. A second gate valve 128 is located between third chamber 124 and second chamber 112, and can be opened to allow sample plates to be transferred between the third chamber 124 and the second chamber 112. The second gate valve 128 can also be closed to isolate the pressure in second chamber 112 from the pressure in third chamber 124.

Figure 3:
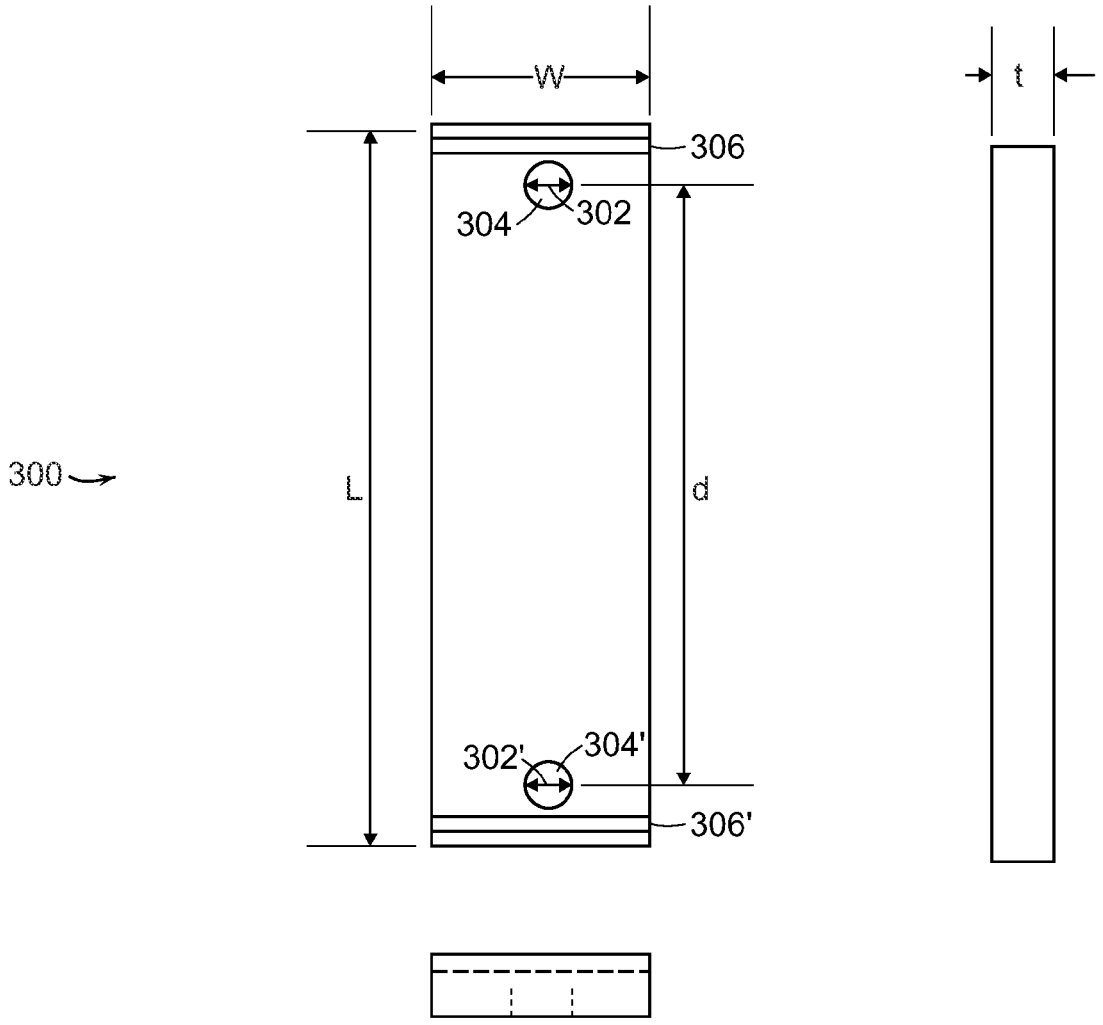
FIG. 3 illustrates an embodiment of a sample plate, according to the present teaching.

In the sample plate handling system 100, a first linear extender 134 moves sample plates 300, illustrated in FIG. 3, between the first and second chambers 102, 112, and a second linear extender 132 moves sample plates 300 between the second and third chambers 112, 124. The first linear extender 134 comprises a catch and release mechanism that pushes sample plates 300 from the first chamber 102 to the second chamber 112 and that pulls sample plates 300 from the second chamber 112 to the first chamber 102. Similarly, the second linear extender 132 comprises a catch and release mechanism that pushes sample plates 300 from the third chamber 124 to the second chamber 112 and that pulls sample plates 300 from the second chamber 112 to the third chamber 124.

Figure 2:
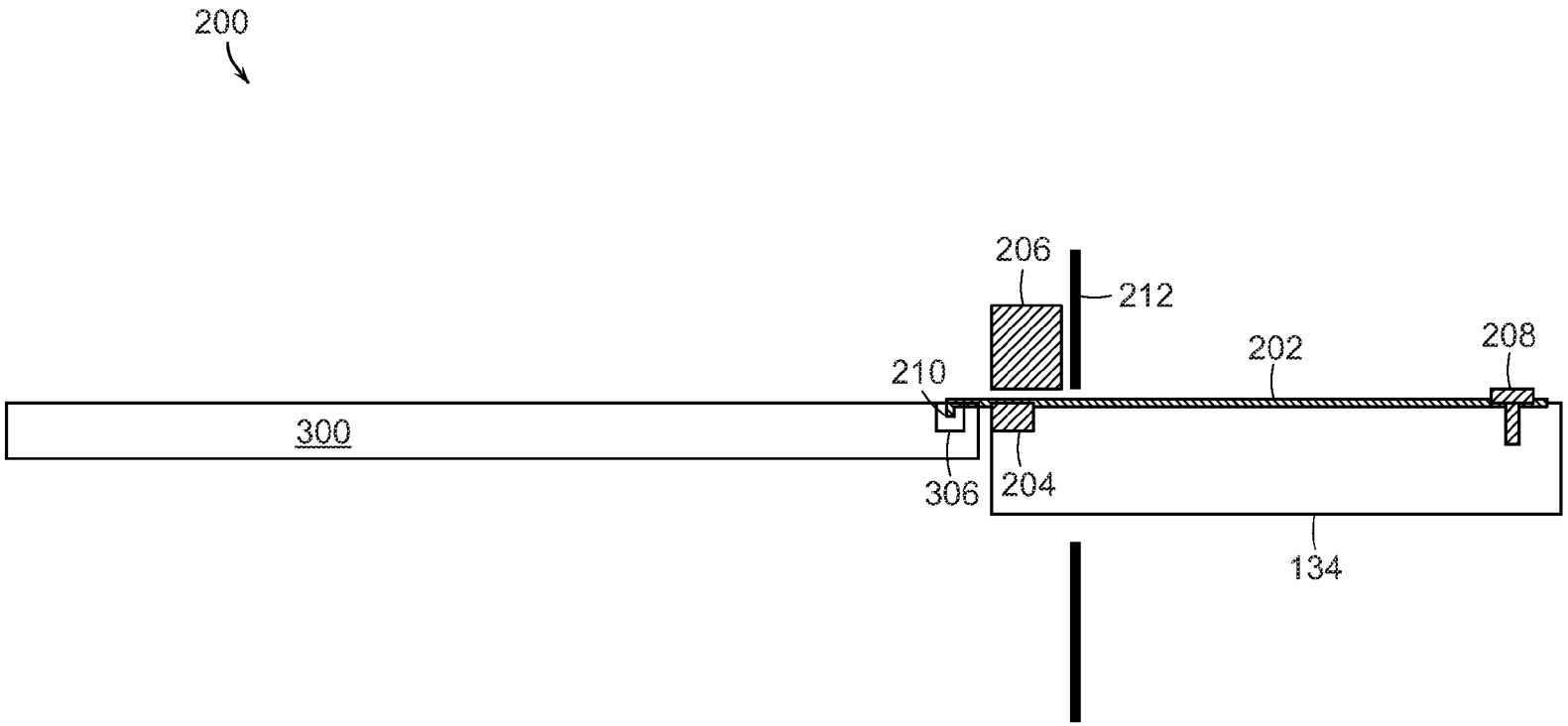
FIG. 2 illustrates a linear extender according to the present teaching with a catch and release mechanism.

FIG. 2 illustrates a linear extender according to the present teaching with a catch and release mechanism 200. The catch and release mechanism 200 is designed to engage a feature in sample plate 300. In one specific embodiment, the catch and release mechanism comprises a leaf spring 202 as illustrated in FIG. 2. The leaf spring 202 is attached to the first linear extender 134 by a screw or rivet 208 and extends beyond the end of first linear extender 134 to engage with the slot 306 in the sample plate 300 shown in FIG. 3. For example, the end of the leaf spring 202 may be formed by bending the end 210 so that it enters slot 306 and captures the sample plate 300.

FIG. 3 illustrates an embodiment of a sample plate 300, according to the present teaching. In some embodiments, the sample plate 300 is formed from magnetic material such as 400-series stainless steel, but one skilled in the art will appreciate that many other materials can be used. In one particular embodiment, the dimensions of the sample plate 300 are L=86 mm, W=27 mm, and t=6 mm. The sample plate 300 includes alignment holes 304, 304' through at least one surface of the sample plate 300. In one embodiment, the distance between the center of hole 304 and the center of hole 304', d, is 80 mm, and the diameters, 302, 302', of holes 304, 304' are 2 mm. Sample plate 300 includes features to allow mechanical engagement for push-pull motion from either linear extender 134 or 132 described in connection with FIG. 1. In one embodiment, slots 306 and 306' are provided, as illustrated in FIG. 3, to allow mechanical engagement for push-pull motion employing a catch and release mechanism. The catch and release mechanism comprises a leaf spring 202, illustrated in FIG. 2, attached to linear extender 134 or 132 by a screw or rivet 208, and that extends beyond the end of linear extender 134 or 132 to engage with the slot 306 in the sample plate 300. The end of the leaf spring 202 may be formed by bending the end 210 so that it enters slot 306 and captures the modified sample plate 300.

Referring to FIG. 1, FIG. 2, and FIG. 3, the sample plate 300 can be retracted into the first chamber 102 with the first linear extender 134. The leaf spring 202 includes a button 204 of magnetic material located near the end of first linear extender 134. An electromagnet 206 is located adjacent to gate valve 126 and above the leaf spring 202. When the electromagnet 206 is energized by applying an appropriate voltage to the winding, the end of leaf spring 202 is raised sufficiently so that end 210 is no longer engaged with slot 306 in the sample plate 300. In this configuration, the first linear extender 134 may be retracted leaving the sample plate 300 in the second chamber 112. When the electromagnet 206 is not energized by applying an appropriate voltage to the winding, the end of leaf spring 202 is not raised and end 210 remains engaged with slot 306 in the sample plate 300. In this configuration, the first linear extender 134 may be retracted moving sample plate 300 from the second chamber 112 to the first chamber 102.

Figure 4:
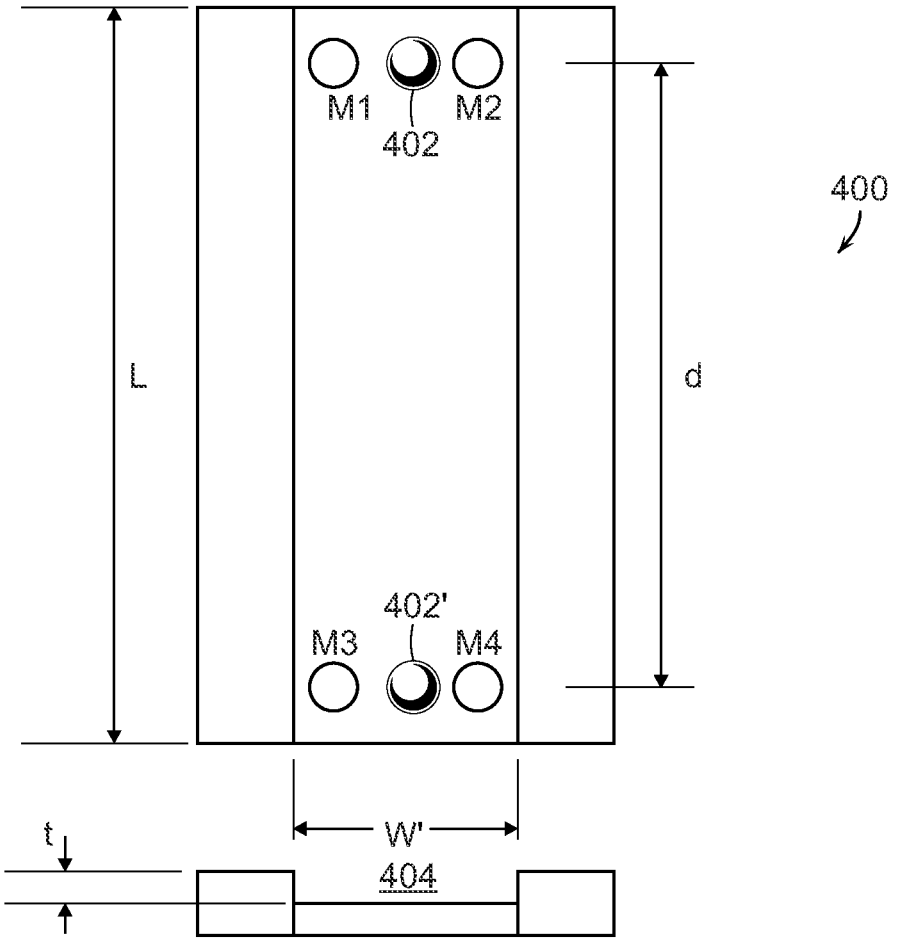
FIG. 4 illustrates an embodiment of a sample plate receiver, according to the present teaching.

FIG. 4 illustrates an embodiment of a sample plate receiver 400, according to the present teaching. Referring to both FIGS. 3 and 4, in the sample plate receiver 400, spring-loaded balls 402, 402' engage holes 304, 304' to locate sample plate 300 in slot 404. Slot 404 is W' wide and t thick. Magnets M1, M2, M3, and M4 attract magnetic sample plate 300 shown in FIG. 3, and hold the sample plate 300 in position in sample plate receiver 400.

Figure 5:
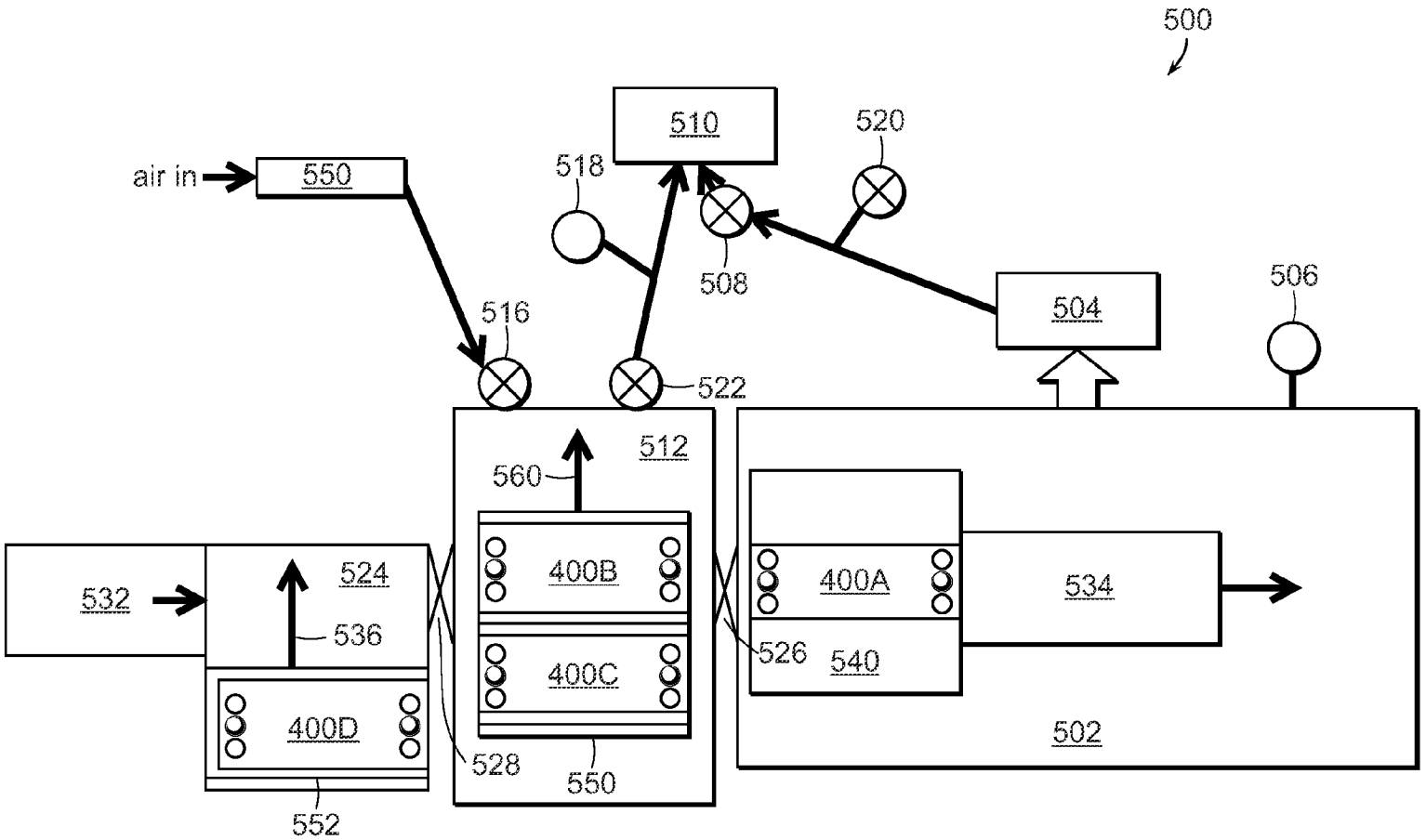
FIG. 5 illustrates a schematic diagram that depicts example locations of the sample plate receivers of the sample plate handling system for the mass spectrometer described in connection with FIG. 1.

FIG. 5 illustrates a schematic diagram of the sample plate handling system 500 for a mass spectrometer that depicts example locations of the sample plate receivers 400 depicted in FIG. 4. In the embodiment illustrated in FIG. 5, the first chamber 502 comprises the ion source chamber of a time-of-flight mass spectrometer. A first sample plate receiver 400A is mounted on a table 540 within the first chamber 502 and can move in two dimensions relative to an ion optic axis of the mass spectrometer. The sample plate 300 can be installed on the first sample plate receiver 400A. Table 540 provides two dimensional mobility allowing samples deposited at different positions on the surface of sample plate 300 to be analyzed. The second chamber 512 comprises a load-lock chamber for the mass spectrometer and includes two sample plate receivers 400B and 400C that are mounted on plate holder 550, which is moved in one dimension by the linear extender 560. At least one additional sample plate receiver 400D is mounted on sample plate holder 552, which is moved in one dimension by the linear extender 536 in the third chamber 524, while at atmospheric pressure.

Referring to FIGS. 2 and 5, the catch and release mechanism of the present teaching allows rapid ejection of completed plates from the first chamber 502 to the second chamber 512 and loading of new plates from second chamber 512 to the first chamber 502. With the first linear extender 534 fully extended, the electromagnet 206 is powered to raise the leaf spring 202 and release the completed plate into second chamber 512. The linear extender 534 is retracted a short distance to clear the sample plate and then the linear extender 560 indexes to the position of a new sample plate. The linear extender 534 is extended to engage the new plate with electromagnet 206 energized. The electromagnet 206 is then de-energized to catch the new plate. The first linear extender 534 then retracts to transfer the new sample plate to the sample plate holder 540.

One feature of the present teaching is that a second sample plate 300' can be transferred from the third chamber 524 at atmosphere to the load-lock chamber 512, and the load-lock chamber 512 can then be evacuated while analysis of a first sample plate 300 is simultaneously being performed in the ion source chamber 502. After the mass spectrometer has been turned on and the instrument is in the process of analyzing samples on the first sample plate 300, a new "LOAD PLATE" cycle can be automatically initiated by placing a new sample plate 300' in plate receiver 400D. In response to this command, the foreline valve 508 is closed, the roughing valve 522 is closed, and the vent valve 516 is opened.

When the second chamber 512 reaches atmospheric pressure, sample receiver 400C on the holder 550 is aligned with the second gate valve 528 by the linear extender 560. In this configuration, sample receiver 400C is designated as the "Load" receiver and sample receiver 400B is designated as the "Eject" receiver. Sample receiver 400D is also aligned with second gate valve 528 by the linear extender 536 positioned in the third chamber 524, which is at atmospheric pressure. The second sample plate 300', which is mounted on sample plate receiver 400D, is transferred by linear extender 532 to sample receiver 400C in the second chamber 512. The second gate valve 528 and vent valve 516 is then closed. The roughing valve 522 is opened. When the vacuum indicated by TC gauge 518 reaches 0.01 Torr, the foreline valve 508 is opened and the system is in the "Ready" state.

When the analysis in progress on the first sample plate 300 is completed, the gate valve 526 is opened and the completed sample plate 300 is transferred to the currently unoccupied sample receiver 400B on sample plate holder 550. Sample receiver 400C that is carrying the second sample plate 300' is then aligned with first gate valve 526 so that the second sample plate 300' can be transferred to the first chamber 502 for analysis. The first gate valve 526 is then closed, and when the BA gauge 506 reads pressure less than a predetermined safe operating pressure, which is typically about $10^{-5}$ Torr, the system has returned to the "Ready" state. The mass spectrometer is then turned on and the instrument proceeds to analyze the sample on the second sample plate 300'. This allows the dead time between analyses of sequential plates to be insignificant relative to the time required for the analysis, because the time to reduce the pressure in the lock chamber from atmosphere to the operating pressure of 0.01 Torr does not contribute to the total dead time.

After analysis of second plate 300' has begun, a new "LOAD PLATE" cycle can be automatically initiated by placing a third sample plate 300" (FIG. 3) in plate receiver 400D. In response to this command, the foreline valve 508 is closed, the roughing valve 522 is closed, and the vent valve 516 is opened. When the second chamber 512 reaches atmospheric pressure, sample receiver 400C on the holder 550 is aligned with the second gate valve 528 by the linear extender 560. Sample receiver 400C is designated as the "Load" receiver and sample receiver 400B is designated as the "Eject" receiver. Sample receiver 400D is also aligned with second gate valve 528 by the linear extender 536 positioned in the third chamber 524, which is at atmospheric pressure. The third sample plate 300", which is mounted on sample plate receiver 400D, is transferred by linear extender 532 to sample receiver 400C in the second chamber 512. Linear extender 560 then aligns plate receiver 400B with gate valve 528. First sample plate 300 that has been analyzed is then transferred from plate receiver 400B to plate receiver 400D. The second gate valve 528 and vent valve 516 are then closed. The roughing valve 522 is opened and the second chamber 512 is evacuated.

When the analysis in progress on the second sample plate 300' is completed, a new "LOAD PLATE" cycle can be initiated by removing completed sample plate 300 from sample plate receiver 400D and installing a fourth sample plate 300'" (FIG. 3) on sample plate receiver 400D. Analysis of sample plates can continue automatically at a rate determined by the analysis time in the source, provided sufficient samples are available for analysis.

Thus, a feature of the methods and apparatus of the present teaching is that the dead time, which is the time between analyses of sequential plates, can be an insignificant time relative to the time required for the analysis. This results from the fact that the time to reduce the pressure in the lock chamber from atmosphere to the operating pressure of 0.01 Torr does not contribute to the total dead time. A feature of the embodiments of the sample plate handling systems illustrated in FIGS. 1 and 5, which include three chambers, is that the volume of the second chambers of each embodiment, 112, 512, can be made much smaller than the volume of the first chambers of each embodiment 102, 502. In one embodiment of the present teaching, the ratio of the volume of the first chamber to that of the second chamber is greater than 100. Thus, if the initial pressure in the second chamber 512 is less than $10^{-2}$ Torr, the maximum pressure increase in the first chamber 502 resulting from a plate transfer is less than $10^{-4}$ Torr. This means the vacuum level of the first chamber 502 can return very quickly to a desired operating pressure of less than $10^{-5}$ Torr. In some embodiments, this initial pressure increase may be small enough to allow the high voltages to be left on during the plate transfer, thereby removing any warm-up time required before the next date acquisition begins. This feature of the present teaching further simplifies and reduces the time for sample analysis.

Another feature of the methods and apparatus of present teaching is that it allows great flexibility in the speed and convenience of sample analysis. In applications requiring high throughput, the speed is limited almost entirely by the time required to analyze the samples on the sample plate. In other applications where the throughput is lower, but where it is desirable to obtain results on a sample quickly after the sample is prepared for analysis, the minimal dead time is also important. Often it is desirable to obtain results on a high priority sample as quickly as possible even though the instrument may be engaged in analyzing samples of lower priority. In this case, if a sample plate is labeled "high priority" the analysis in progress can be paused and the high priority sample loaded and analyzed with minimal delay. When a "high priority" sample is loaded into sample plate receiver 400D, acquisition of the sample plate on sample plate receiver 400A is paused and the position of the plate at the time of the pause is recorded by the data system. This plate is immediately ejected to sample plate receiver 400B and the plate in sample plate receiver 400C is transferred to sample plate receiver 400A in chamber 502.

A "LOAD PLATE" cycle is then initiated and the "high priority" sample is transferred to receiver 400C, and the paused plate is transferred from 400B to 400D. The second chamber 512 is then evacuated and the plate in receiver 400A in chamber 502 is transferred to receiver 400B, after which time the "high priority" plate is transferred to chamber 502 and analysis of the "high priority" sample begins. In one embodiment, the total time required for loading the "high priority" sample and beginning the analysis is less than one minute. When the "high priority" sample analysis is completed, the paused sample can be automatically reloaded and the analysis can proceed from the point that it was paused.

Figure 6:
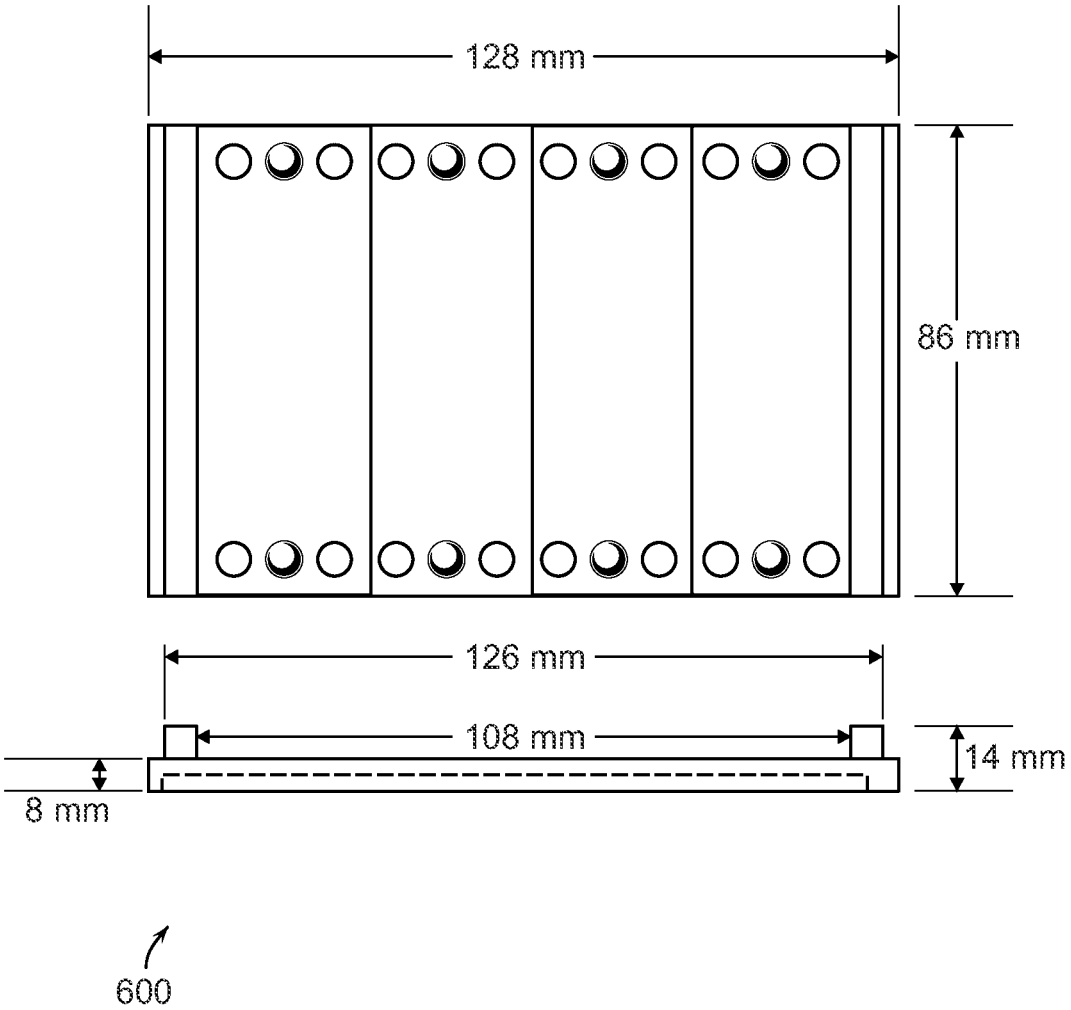
FIG. 6 illustrates a microtiter compatible plate holder comprising four sample plate receivers.

The embodiment illustrated in FIG. 5 allows manual loading of one sample plate at a time. FIG. 6 illustrates a schematic diagram of a sample plate holder 600 for a fully automated sample plate handling system for a mass spectrometer, wherein four or more sample plates can be simultaneously or sequentially loaded into a third chamber at atmospheric pressure. The plate holder 600 comprises four sample plate receivers having total outer dimensions corresponding to the standard microtiter format, which allows for compatibility with standard robotic sample preparation and handling.

Figure 7:
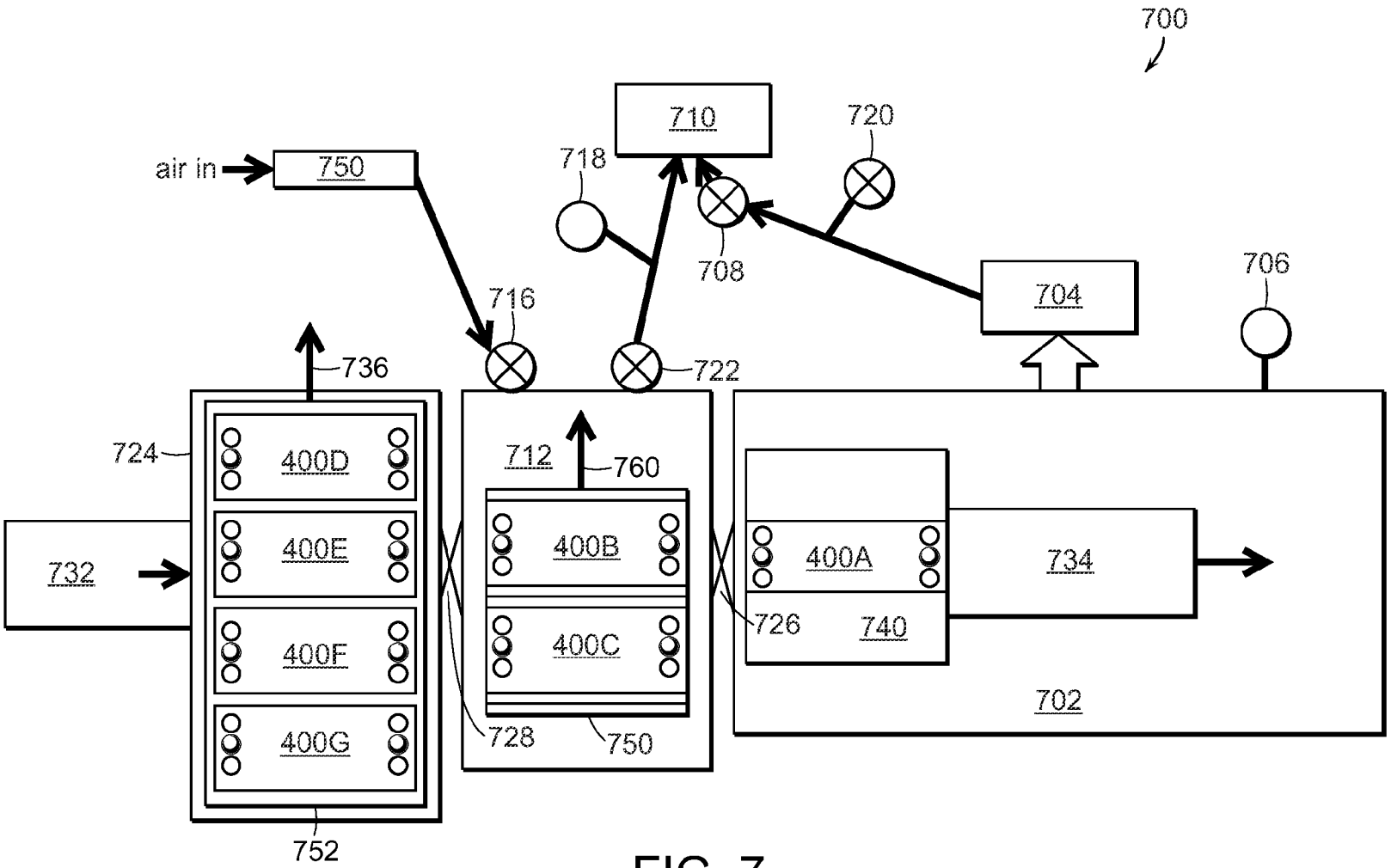
FIG. 7 illustrates a schematic diagram of a fully automated sample plate handling system for a mass spectrometer according to the present teaching where four or more sample plates can be simultaneously or sequentially loaded into a third chamber at atmospheric pressure.

FIG. 7 illustrates a schematic diagram of a fully automated sample plate handling system according to the present teaching for a mass spectrometer wherein four or more sample plates can be simultaneously or sequentially loaded into a third chamber at atmospheric pressure. This embodiment is similar the sample plate handling system 500 described in connection with FIG. 5, but is capable of accommodating a number of plates in the third chamber at atmospheric pressure. The embodiment illustrated in FIG. 7 shows four plates, which may be the sample plate holder 600 of FIG. 6. The linear extender 736 moves in one dimension to align any one of the sample plate receivers 400D, 400E, 400F, and 400G with the second gate valve 728. In one embodiment, sample plate receivers that were originally occupied by sample plates that have been transferred into chambers 702 or 712 are kept unoccupied until those plates are completed, at which time they are returned to their original receivers. In another embodiment, a completed plate is returned to the sample plate receiver vacated by the last sample plate loaded. Two or more holders, such as those illustrated in FIG. 6, can be loaded into the third chamber 724 so that continuous automatic operation occurs until there are no more plates available for analysis.

In some applications of mass spectrometers, the time required to collect and prepare samples and to deposit samples onto the sample plate is long compared to the time required to analyze the samples in the mass spectrometer. The sample plate handling system of the present teaching provides optimum performance for these applications. For these applications, it is important to begin mass spectrometric analysis as quickly as feasible following loading of a sample plate. In systems according to the present teaching, the dead time between presenting a sample to the plate receiver at atmospheric pressure and beginning the mass spectrometric analysis is the time required to evacuate the load lock chamber. This time is determined by the volume of the load lock chamber and the pumping speed of the mechanical vacuum pump as modified by the conductance of the roughing valve and associated pumping line. In one embodiment, the time to reach a desired pressure of 0.01 Torr is less than one minute.

In other applications of mass spectrometers, samples can be prepared and deposited on the sample plate more rapidly than the samples can be analyzed in the mass spectrometer. The sample plate handling system of the present teaching also provides optimum performance for these applications. In applications requiring high throughput, the important dead time between analysis of sequential sample plates is the time required to remove a completed plate from the first chamber and to load the next plate from the load lock. In one embodiment, this time is less than 10 seconds because of the design described herein. The time required to evacuate the load lock from atmospheric pressure to a desired pressure of 0.01 Torr or less is not limiting since this is accomplished while the first plate is simultaneously being analyzed by the mass spectrometer. In most practical applications, the time required to analyze the samples on a plate is substantially greater than one minute. Thus, the time required to evacuate the load lock in the sample plate handling system according to the present teaching does not reduce the throughput.

EQUIVALENTS

While the Applicants' teaching is described in conjunction with various embodiments, it is not intended that the Applicants' teaching be limited to such embodiments. On the contrary, the Applicants' teaching encompass various alternatives, modifications, and equivalents, as will be appreciated by those of skill in the art, which may be made therein without departing from the spirit and scope of the teaching.

What is claimed is:

1. A sample plate handling system for a time-of-flight mass spectrometer, the sample plate handling system comprising:

a) a sample plate for supporting samples for analysis;

b) a first sample plate receiver positioned in a first chamber;

c) a first and second sample plate receiver positioned in a second chamber;

d) a first gate valve positioned between the first chamber and the second chamber, the first gate valve isolating the first and second chambers when closed and allowing transfer of sample plates between the first sample plate receiver in the first chamber and one of the first and second sample plate receivers in the second chamber when the first gate valve is open;

e) a first linear extender that pushes a sample plate from the first sample plate receiver in the first chamber to the first sample plate receiver positioned in the second chamber, and then retracts a second sample plate from the second sample plate receiver positioned in the second chamber and transports the second sample plate to the first sample plate receiver in the first chamber;

f) a first sample plate receiver positioned in a third chamber;

g) a second gate valve positioned between the third chamber and the second chamber, the second gate valve isolating the third chamber from the second chamber when closed and allowing transfer of sample plates between the first sample plate receiver in the third chamber and one of the first and second sample plate receivers in the second chamber when the second gate valve is open; and h) a second linear extender that pushes a sample plate from the first sample plate receiver in the third chamber to the first sample plate receiver positioned in the second chamber, and then retracts the second sample plate from the second plate receiver positioned in the second chamber and transports it into the third chamber.

2. The sample plate handling system of claim 1 wherein the first chamber comprises an ion source chamber, the ion source chamber comprising an ion source that ionizes a sample of interest on a sample plate positioned therein.

3. The sample plate handling system of claim 2 further comprising a vacuum system for controlling pressure in the first and second chambers, the vacuum system comprising:

a) a turbomolecular vacuum pump coupled to the ion source chamber;

b) a mechanical vacuum pump coupled to the outlet of the turbomolecular vacuum pump through a first electrically activated isolation valve and coupled to the second chamber through a second electrically activated isolation valve;

c) an air source coupled to the second chamber through a first electrically activated vent valve and coupled to the inlet of the turbomolecular pump through a second electrically activated vent valve;

d) first and second electrical activators for the first and second gate valves;

e) a first vacuum gauge for measuring a pressure at the inlet of the mechanical vacuum pump;

f) a second vacuum gauge for measuring pressure in the first chamber; and g) a control system for controlling the first and second electrically activated isolation valve and the first and second electrically activated vent valve in response to the pressure readings from the vacuum gauges.

4. The sample plate handling system of claim 3 wherein a time required to reduce a pressure in the second chamber from atmospheric pressure to a first predetermined operating pressure is less than one minute.

5. The sample plate handling system of claim 4 wherein the first predetermined operating pressure is 0.01 Torr and the second predetermined operating pressure 0.01 mTorr.

6. The sample plate handling system of claim 3 wherein a time required to transfer a sample plate from the load lock at a first predetermined operating pressure to a second predetermined operating pressure in the first chamber is less than 10 seconds.

7. The sample plate handling system of claim 2 wherein the second chamber comprises a load-lock chamber that supports the first and second sample plate receivers, wherein sample plates can be transferred into and out of the load-lock chamber while analysis is being performed in the ion source chamber, thereby increasing the utilization of the mass spectrometer.

8. The sample plate handling system of claim 2 configured so that one sample plate is under analysis in the ion source chamber while another sample plate is simultaneously loaded into the load-lock chamber.

9. The sample plate handling system of claim 1 wherein the first linear extender comprises a catch and release mechanism that pushes the sample plate from the first chamber to the second chamber and that pulls the sample plate from the second chamber to the first chamber.

10. The sample plate handling system of claim 1 wherein the second linear extender comprises a catch and release mechanism that pushes the sample plate from the first sample plate receiver in the third chamber to the first sample plate receiver positioned in the second chamber and that pulls the second sample plate from the second plate receiver positioned in the second chamber into the first sample plate receiver in the third chamber.

11. The sample plate handling system of claim 1 wherein the first sample plate receiver within the first chamber is movable so as to align with the first gate valve such that sample plates can be transported onto or off the first sample plate receiver within the first chamber.

12. The sample plate handling system of claim 1 wherein a plurality of sample plate holders are positioned within the third chamber.

13. The sample plate handling system of claim 12 wherein at least one of the plurality of sample plate holders are installed on at least one microtiter-compatible holder.

14. A method for simultaneously performing time-of-flight mass spectrometry analysis of a first sample in a first chamber while transporting sample plates from atmosphere into a second chamber, the method comprising:

a) inserting a first sample plate comprising a first sample into a first chamber for analysis;

b) performing time-of-flight mass spectrometry analysis on the sample positioned on the first sample plate in the first chamber;

c) transporting a second sample plate from atmospheric pressure into a second chamber isolated from the first chamber by a gate valve; and d) evacuating the second chamber while performing time-of-flight mass spectrometry analysis on the sample positioned on the first sample plate in the first chamber, thereby reducing the dead time between analysis of successive samples.

15. The method of claim 14 wherein a throughput of analyzed samples positioned on sample plates is limited by a mass spectrometry analysis time.

16. The method of claim 14 wherein the dead time between analyses of successive plates is less than 10 seconds.

17. The method of claim 14 further comprising activating a first linear extender to push the first sample plate in the first chamber to the second chamber after mass spectrometry analysis.

18. The method of claim 14 further comprising activating the first linear extender to retract the second sample plate from the second chamber and transporting the second sample plate to the first chamber for analysis.

19. The method of claim 14 further comprising activating a second linear extender that pushes a sample plate from a first sample plate receiver in a third chamber to a first sample plate receiver positioned in the second chamber, and then retracting a second sample plate from the second plate receiver positioned in the second chamber and transports it into the third chamber.

20. The method of claim 19 further comprising loading a third sample plate at atmospheric pressure into a load-lock chamber in the second chamber while transporting the second sample plate into the third chamber.

21. The method of claim 19 further comprising pumping the load-lock chamber independent of pumping the first chamber.

22. The method of claim 14 wherein a time to transfer a high priority sample from atmospheric pressure into the first chamber and to begin performing time-of-flight mass spectrometry analysis is less than one minute.

* * * * *